US007789729B1

(12) United States Patent
Ivanic et al.

(10) Patent No.: US 7,789,729 B1
(45) Date of Patent: Sep. 7, 2010

(54) TOY SHOTGUN

(75) Inventors: Robert J. Ivanic, Saugus, CA (US); Joseph Wong Wai Ching, Tai Po (HK); Siu Tsz Ming, Tai Po (HK)

(73) Assignee: Imperial Toy, LLC, North Hills, CA (US)

( * ) Notice: Subject to any disclaimer, the term of this patent is extended or adjusted under 35 U.S.C. 154(b) by 510 days.

(21) Appl. No.: 11/772,611

(22) Filed: Jul. 2, 2007

(51) Int. Cl.

| | |
|---|---|
| ***A63H 33/28*** | (2006.01) |
| ***A63H 33/00*** | (2006.01) |
| ***F41B 7/02*** | (2006.01) |
| ***F41C 3/06*** | (2006.01) |
| ***A63H 5/00*** | (2006.01) |

(52) U.S. Cl. ..... 446/473; 446/24; 446/401; 124/16; 42/54

(58) Field of Classification Search ..... 446/24, 446/398–403, 405–407, 473; 124/16, 55, 124/63, 66; 42/54
See application file for complete search history.

(56) References Cited

U.S. PATENT DOCUMENTS

| | | | | | |
|---|---|---|---|---|---|
| 1,120,320 | A * | 12/1914 | McIntyre | 446/24 |
| 2,537,709 | A * | 1/1951 | Freeman | 407/107 |
| 2,665,676 | A * | 1/1954 | Mobley, Jr. | 124/64 |
| 2,855,715 | A * | 10/1958 | Weimer | 42/58 |
| 3,022,779 | A * | 2/1962 | Benkoe | 124/57 |
| 3,098,474 | A * | 7/1963 | Hirsch et al. | 124/2 |
| 3,465,744 | A * | 9/1969 | Nielsen | 124/27 |
| 3,537,709 | A * | 11/1970 | O'Connell | 273/161 |
| 3,895,459 | A * | 7/1975 | Morrison et al. | 446/430 |
| 4,598,491 | A * | 7/1986 | Noble | 42/58 |
| 5,284,274 | A | 2/1994 | Lee et al. | |
| 5,351,427 | A | 10/1994 | Aigner | |
| 7,156,085 | B2 * | 1/2007 | Lewis et al. | 124/66 |
| 2006/0064911 | A1 * | 3/2006 | Lewis et al. | 42/54 |
| 2006/0116048 | A1 * | 6/2006 | Choi | 446/15 |

* cited by examiner

*Primary Examiner*—Gene Kim
*Assistant Examiner*—Alyssa M Hylinski
(74) *Attorney, Agent, or Firm*—Banner & Witcoff, Ltd.

(57) ABSTRACT

A toy gun is provided with ejecting shells and a smoking chamber. Each ejecting shell has a spring and a recess and is placed into a barrel chamber. The chamber has a post, which compresses the spring when the shell is placed into the chamber. When the hinge is opened, the spring decompresses ejecting the shell from the chamber. The smoke generating assembly is provided with a pump, an oil tank, a heating element, a switch, a visual indicator, and an automatic shutoff. When the switch is actuated, the heating element heats the oil, such that it transforms into a smoke vapor. Upon opening the hinge, the hinge actuates the pump, connected to the tank, which pumps smoke vapor out of the tank through an opening in the post such that smoke appears in the chamber.

19 Claims, 7 Drawing Sheets

FIG.10
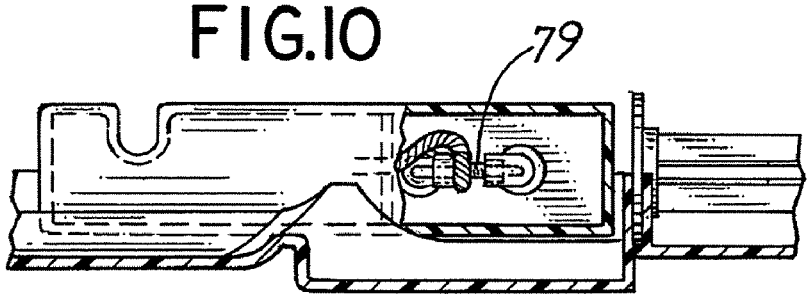
FIG.16
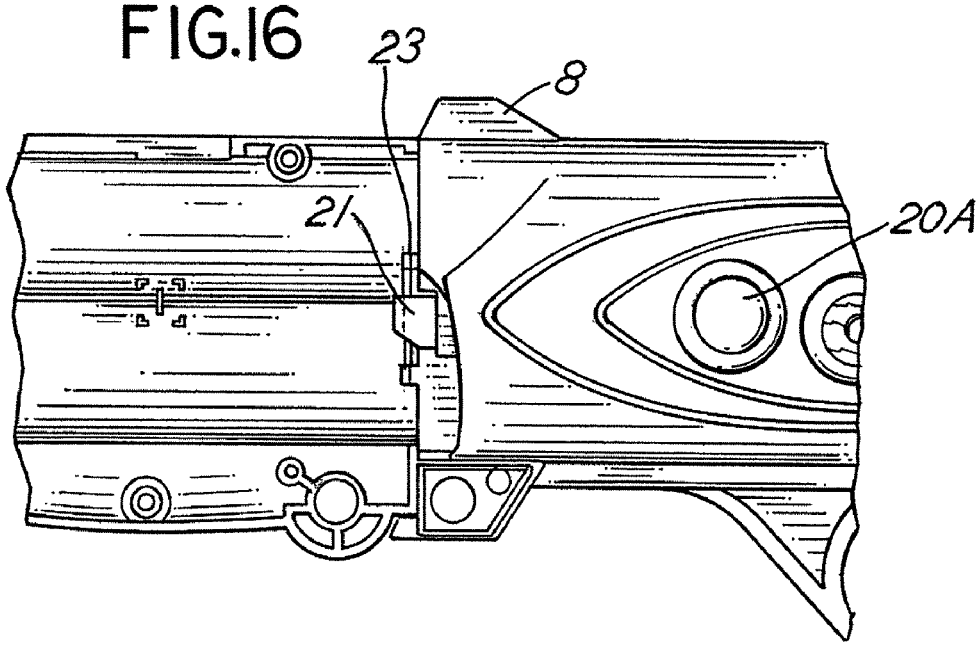
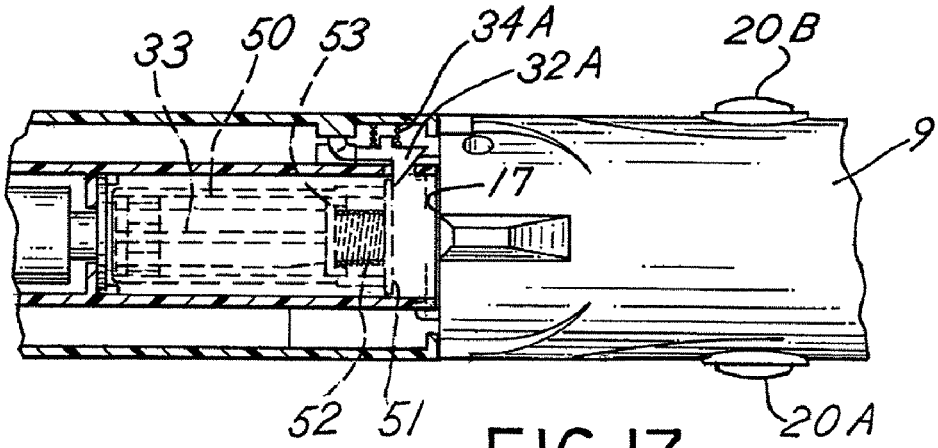
FIG.17

TOY SHOTGUN

BACKGROUND OF THE INVENTION

1. Field of the Invention

The present invention relates to toys designed to be carried and used by children engaged in action play. More particularly, this invention relates to a new toy weapon that imitates weapons from the Wild West.

2. Description of Related Art

Toy guns that simulate real guns have been available in the marketplace for years. These toys typically resemble actual guns and may simulate certain features of a real gun. The present invention is directed at simulating features of realistic guns.

BRIEF SUMMARY OF THE INVENTION

A toy gun apparatus having a shell, a double barrel, a stock, and a hinge is provided. The toy gun assembly is provided with ejecting shells and a smoking chamber to simulate a realistic gun.

Shells eject when the hinge is opened. Each shell has a spring and a recess and is placed into a barrel chamber. The chamber has a post, which compresses the spring when the shell is placed into the chamber. A shell locking mechanism retains the shell in the chamber. When the hinge is opened, the spring decompresses ejecting the shell from the chamber.

Smoke, produced from a smoke generating assembly, also rises from the chamber when the hinge is opened. The post located in the chamber has openings for allowing smoke to flow into the chamber. The smoke generating assembly is provided with a pump, a tank having oil, a heating element, a switch, a visual indicator, and an automatic shutoff switch. When the switch is actuated, the visual indicator is illuminated, and the heating element heats the oil, such that the oil transforms into a smoke vapor. Upon opening the hinge, the hinge actuates the pump connected to the tank causing smoke vapor to leave the tank, through the opening in the post, into the chamber. The smoke generator assembly has an automatic shutoff, which after a predetermined amount of time, turns the heating element and the visual indicator to an off position.

To operate hinge, a first push button and a second push button are provided. The first push button and the second push button each have an associated first clip and second clip. The first clip and the second clip retain the stock and barrel together when the toy gun assembly is in a shooting position. The first clip and the second clip are released by the pressing of the first push button and the second push button. The hinge opens only by the simultaneous pressing of the first push button and the second push button.

BRIEF DESCRIPTION OF THE DRAWINGS

Other features and advantages of the invention will become apparent to those skilled in the art upon review of the following detailed description, claims and drawings in which like numerals are used to designate like features.

FIG. 10 shows a partial side view of individual components housed within the barrel of the toy gun.

FIG. 16 shows a side view of individual components housed within the handle and receiver of the toy gun.

FIG. 17 shows a top view of individual components housed within the handle and a top view of the receiver of the toy gun.

DETAILED DESCRIPTION OF THE INVENTION

Figure 1:
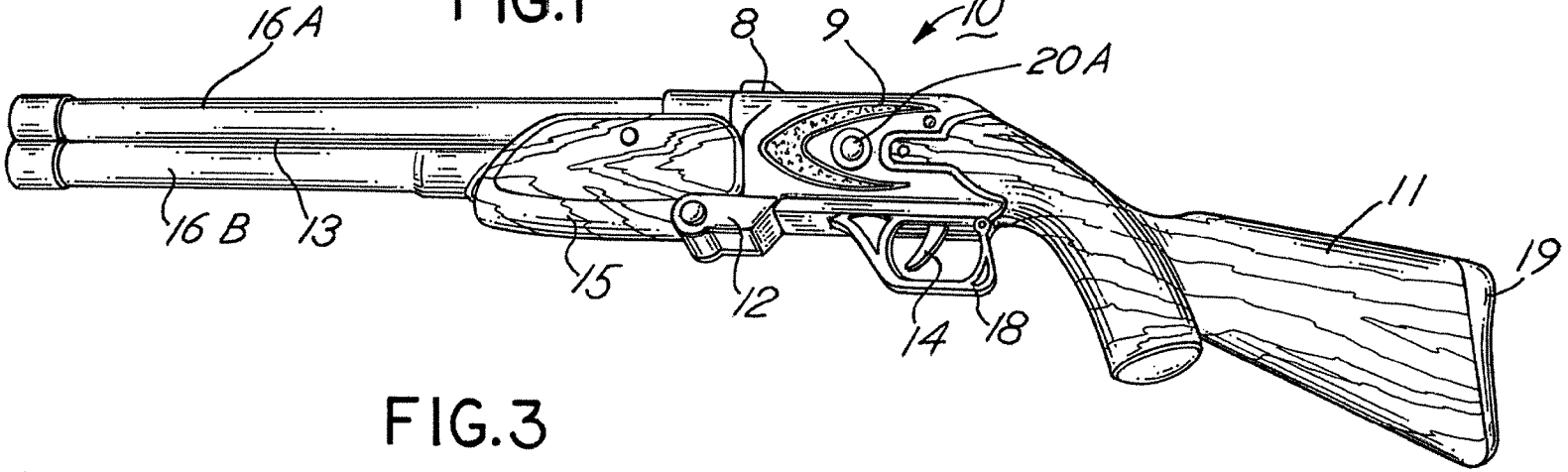
FIG. 1 is a side view showing a toy gun according to the present invention.
Figure 5:
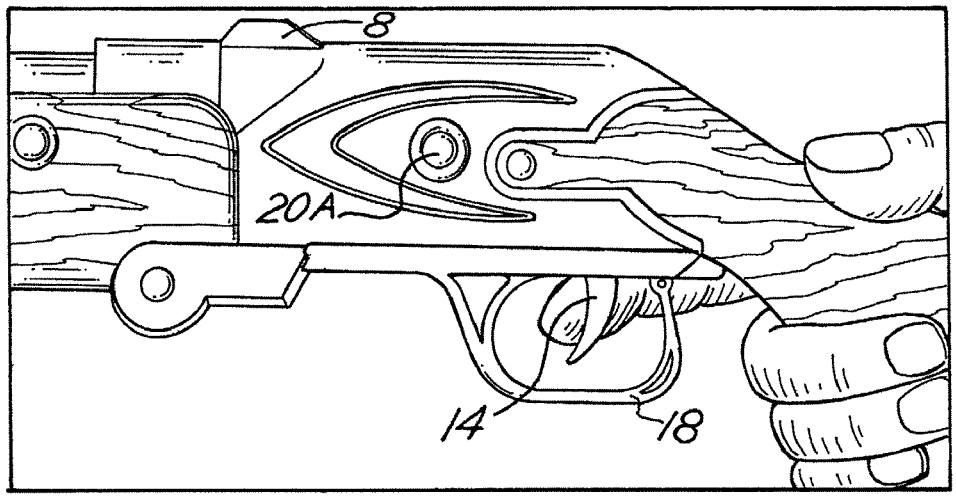
FIG. 5 shows a partial side view of the toy gun from a first perspective.

Referring to FIGS. 1 and 5, a toy gun 10 has a general shape of a shot gun having a stock 11, a butt end 19, a hinge 12, a double barrel 13, a sight 8, a receiver 9, a trigger 14, and a trigger guard 18. The gun is provided with first and second elongated members 16A and 16B, the hinge 12, and a handle 15 to simulate a western style shot gun. When the trigger 14 is actuated, the toy gun 10 produces a shooting noise, which can be produced by a digital recording and a speaker operatively connected to the trigger 14 or various other ways.

Figure 3:
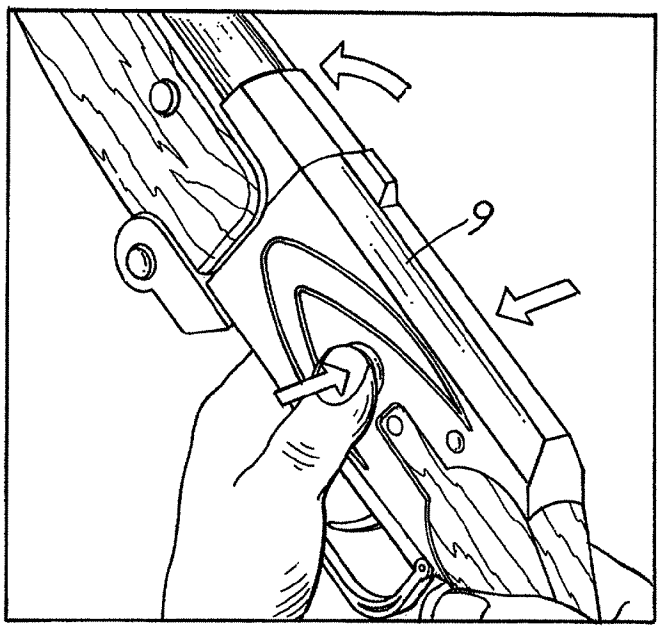
FIG. 3 shoes a partial isometric view of the toy gun in a locked position.
Figure 12:
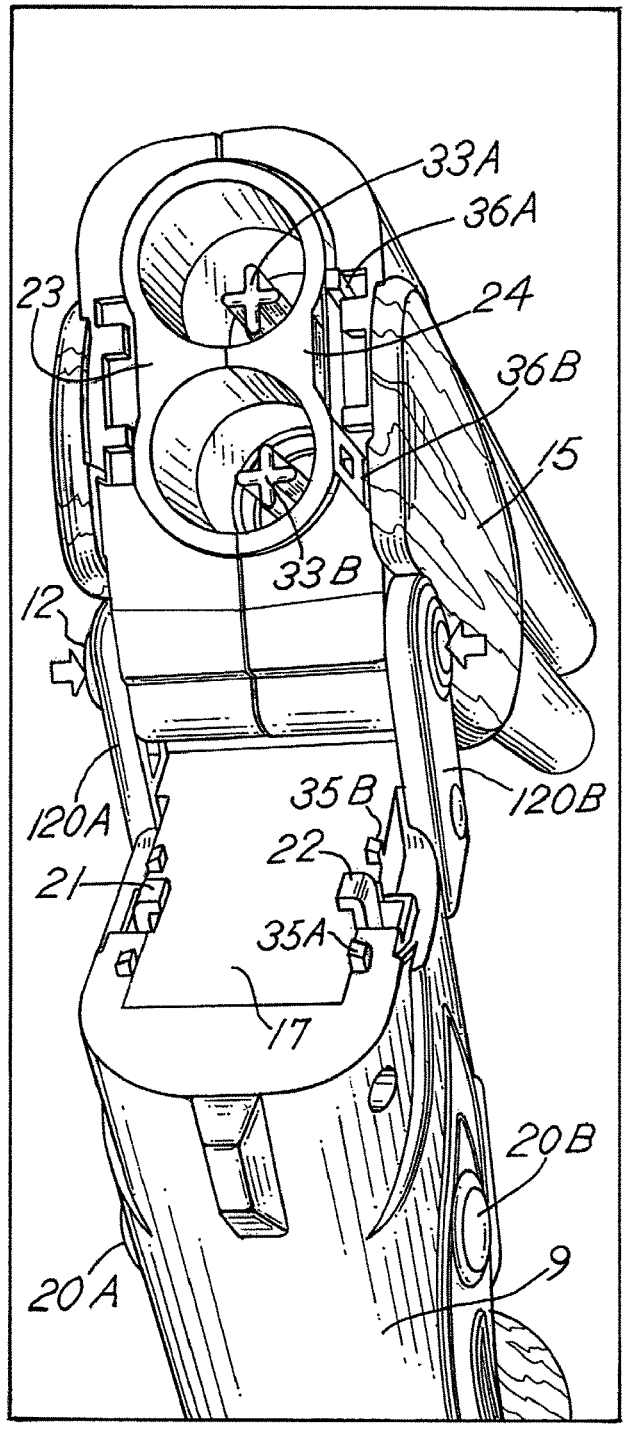
FIG. 12 shows a partial top view of the toy gun in an unlocked position.

To operate the hinge 12 of the toy gun 10, a first push button 20A located on a first side of the receiver 9 and a second push button 20B located on a second side of the receiver 9 (not shown in FIG. 1) are pushed inwardly, as shown by the arrows in FIG. 3. As shown in FIGS. 12 and 16, a face 17 of the receiver 9 is provided with a first clip 21 and a second clip 22. When the toy gun 10 is in the locked position, the first and second clips 21 and 22 engage a first lip 23 and a second lip 24 respectively so as to lock the handle 15 and the receiver 9 in a shooting position. The pushing of the first and second push buttons 20A and 20B inwardly causes the first and second clips 21 and 22 to move outwardly away from each other so as to release the hinge 12. The pressing of only one push button will not release the hinge, because both the first clip 21 and the second clip 22 retain the toy gun in the locked position. Once the toy gun is in the unlocked position as shown in FIG. 12, to lock the gun in the shooting position, the receiver 9 is mated with the handle 15. A first lip 23 and a second lip 24 bias the first clip 21 and the second clip 22 outwardly such that the first and second clips 21 and 22 extend over and engage the first and second lips 23 and 24 respectively. Once the first and second clips 21 and 22 extend over and engage the first and second lips 23 and 24, a spring (not shown) biases the first and second clips 21 and 22 inwardly such that the first and second clips 21 and 22 latch onto the first and second lips 23 and 24 to lock the receiver 9 to the handle 15.

Figure 2:
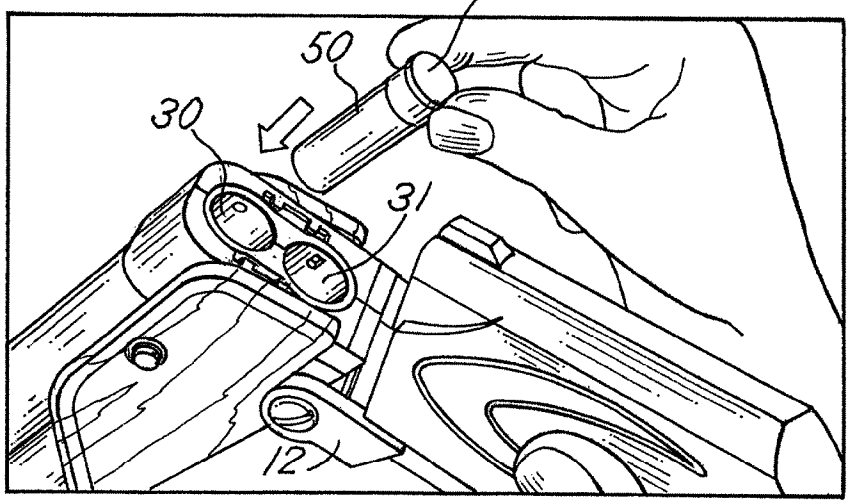
FIG. 2 shows a partial isometric view of the toy gun in an unlocked position.
Figure 4:
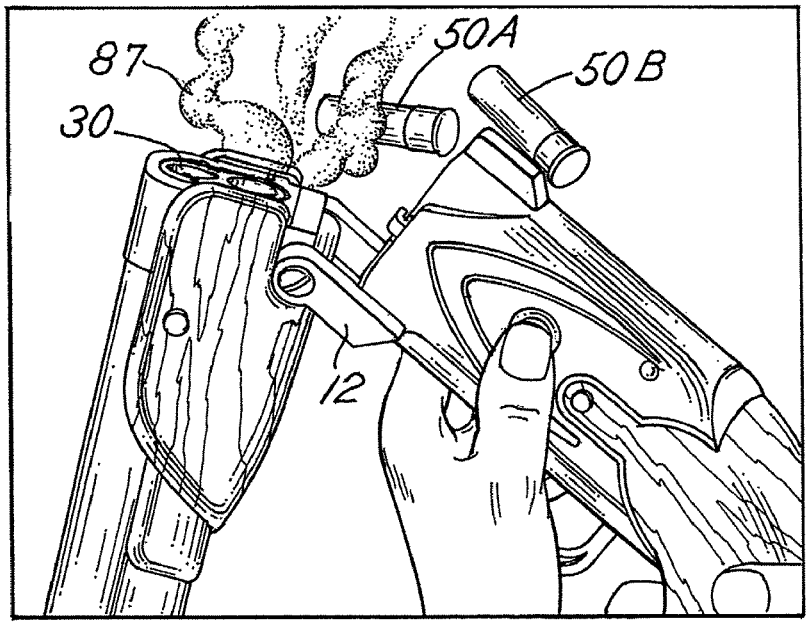
FIG. 4 shows a partial side view of the toy gun in an unlocked position.
Figure 14:
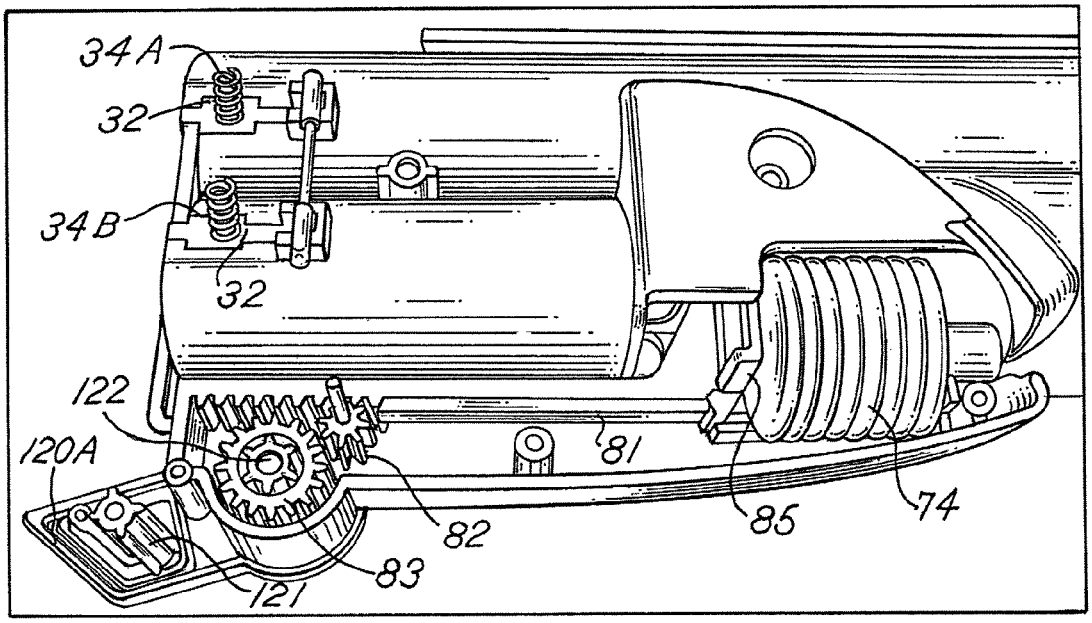
FIG. 14 shows a side view of individual components housed within the handle of the toy gun.
Figure 15:
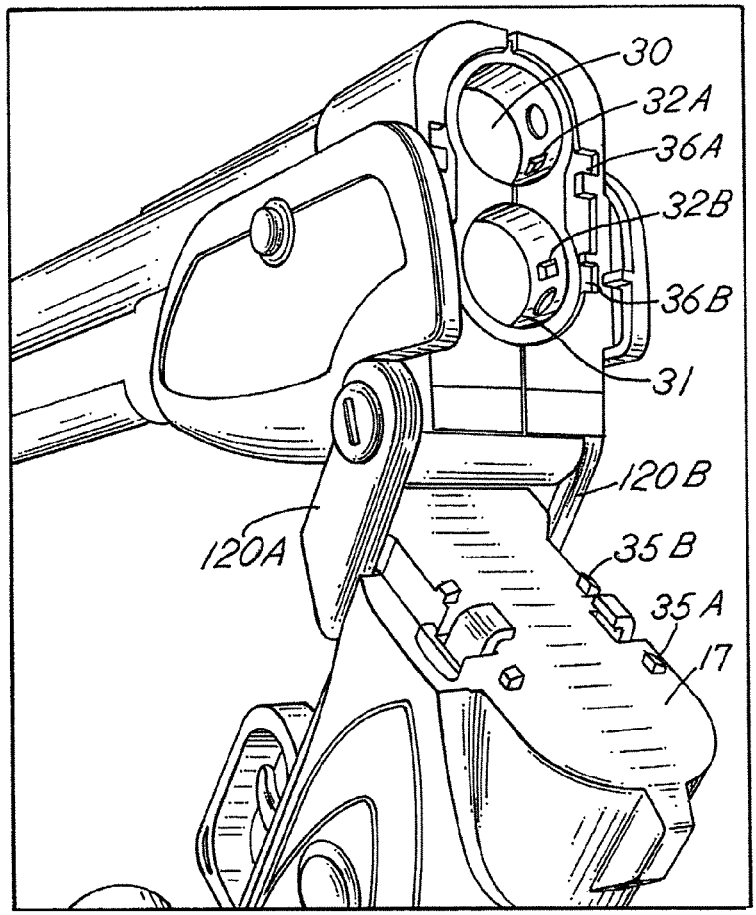
FIG. 15 shows a partial isometric view of the toy gun in the unlocked position.

As depicted in FIG. 4, when the hinge 12 opens, a first shell 50A and a second shell 50B eject from the first and second chambers 30 and 31 respectively. As depicted in FIG. 2, a shell 50 is placed into the first chamber 30. As depicted in FIG. 15, a first shell locking mechanism 32A and a second shell locking mechanism 32B project through the first and second chambers 30 and 31 respectively. Referring to FIG. 14, a first coil spring 34A and a second coil spring 34B respectively bias the first and second shell locking mechanisms 32A and 32B radially inward such that the first and second shell locking mechanisms 32A and 32B project into the first and second chambers 30 and 31 respectively. As shown in FIGS. 2 and 17, the shell locking mechanism 32A has an angled surface, such that as the shell 50 is placed into the chamber 30 the outer portion of the shell 50 pushes the shell locking mechanism 32A radially outward. Once the shell 50 moves past the shell locking mechanism 32A, the coil spring 34A biases the shell locking mechanism radially inward over an end lip 51 of the shell 50 and holds the shell 50 in the first chamber 30. The shell locking mechanism 32B has the same structure and operates in identical fashion.

Figure 11A:
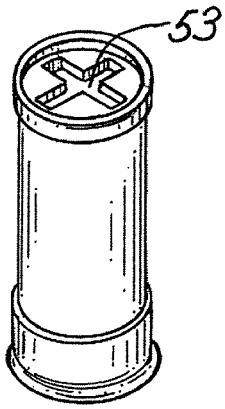
FIG. 11A shows an isometric view of a shell used in connection with the toy gun.
Figure 11B:
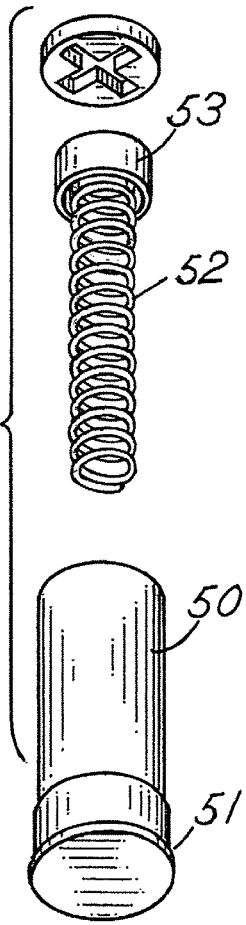
FIG. 11B shows an exploded view of a shell used in connection with the toy gun.

As depicted in FIGS. 11A and 11B, the shell 50 is provided with a coil spring 52 and a cap 53. The spring 52 is preferably made of metal. The cap 53 is allowed to move axially within a recess in the shell 50 as the coil spring 52 is compressed and is allowed to decompress. As shown in FIG. 12, the first and second chambers 30 and 31 are provided respectively with a first post 33A and a second post 33B. Each of the first and second posts 33A and 33B has a plus-shaped cross-section. One end of the shell 50 is also provided with a corresponding plus-shaped cross-section. As the shell 50 is placed in the first chamber 30, the post 33A pushes against the cap 53 such that the cap 53 moves axially downward in the shell 50 thereby compressing the coil spring 52. The second chamber 31 and post 33B function in an identical fashion.

Shown in FIGS. 12 and 15, the face 17 of the receiver 9 is provided with a first projection 35A and a second projection 35B for releasing the respective first and second shell locking mechanisms 32A and 32B. When the hinge 12 is in the closed position, the first projection 35A and the second projection 35B project into the respective first and second slots 36A and 36B so as to cause the shell locking mechanism 32 to move radially outward. Angled portions of the first projection 35A and the second projection 35B contact the angled portions of the first and second shell locking mechanisms 32A and 32B causing the first and second shell locking mechanisms 32A and 32B to move radially outward. As the first shell locking mechanism 32A, shown in FIG. 17, is moved radially outward, the first shell locking mechanism 32A releases the shell lip 51. This allows the coil spring 52 to decompress slightly causing the shell 50 to move a small distance outward in first chamber 30. When the toy gun is in the locked position, the face 17 acts as a stop for the shell 50. Once the hinge 12 is opened, the coil spring 32 will decompress fully, thereby ejecting the shell 50 completely out of the first chamber 30. The second chamber 31 and the second shell locking mechanism 32B operate in identical fashion.

As depicted in FIGS. 12, 14, and 15, the hinge 12 is provided with a first plate 120A and a second plate 120B. Each plate has a first hinge post 121 and a second hinge post 122. Both the first and second plates 120A and 120B pivot about their respective hinge posts 122. The first and second plates 120A and 120B mount to the handle 15 through their respective first posts 121 and mount to the receiver 9 through their respective second posts 122.

Figure 6:
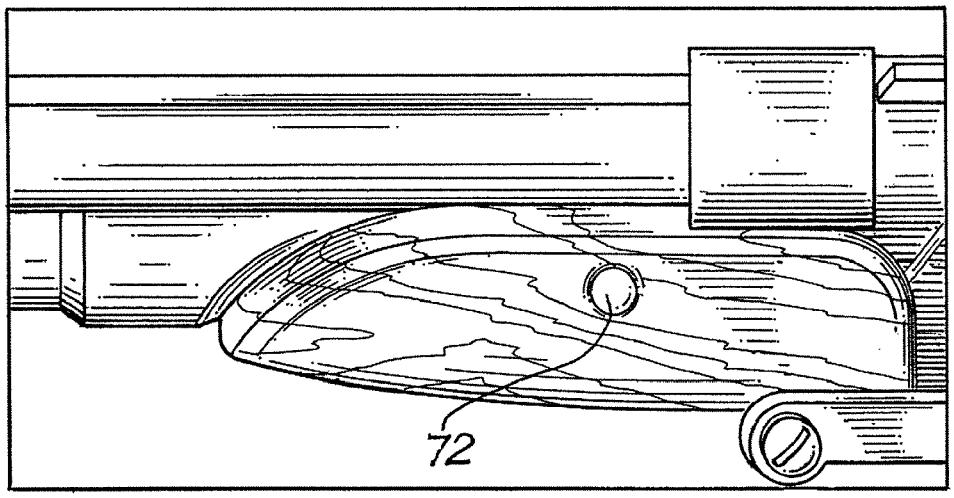
FIG. 6 shows a partial side view of the toy gun from a second perspective.
Figure 7:
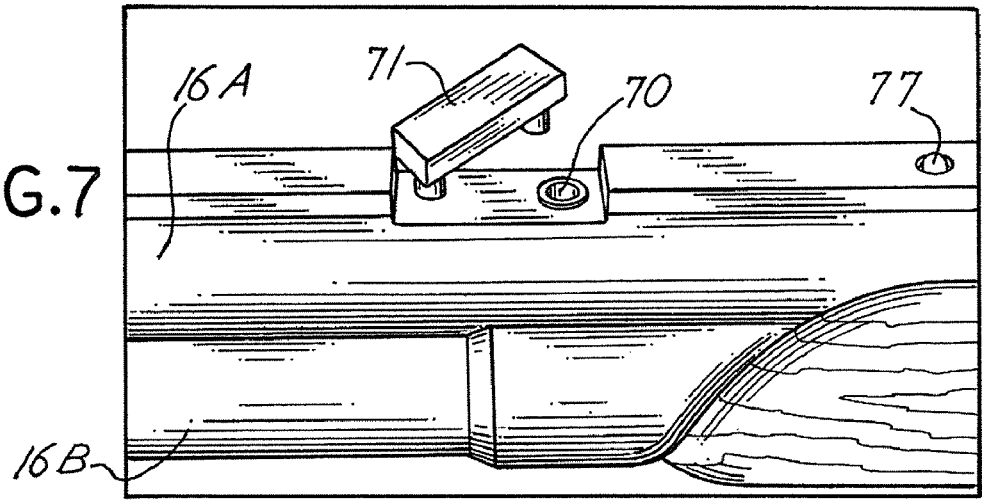
FIG. 7 shows a partial side view of the toy gun from a third perspective.
Figure 8:
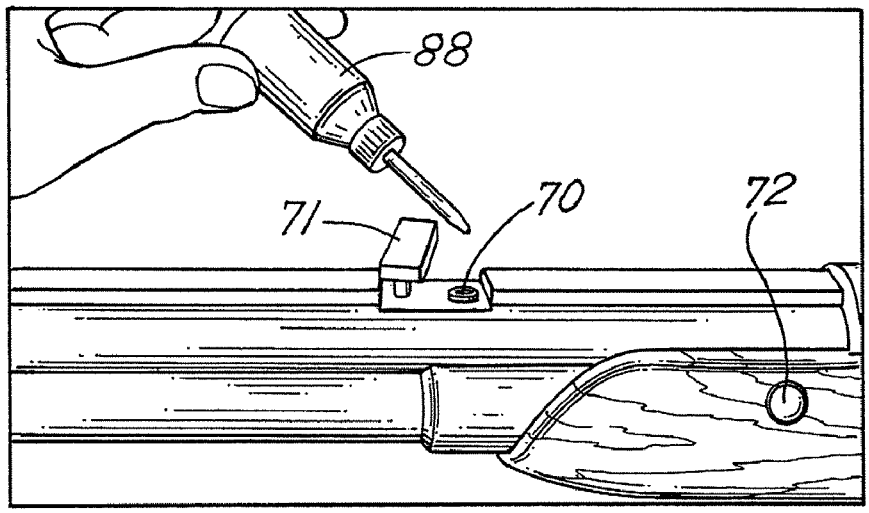
FIG. 8 shows a partial side view of the toy gun from a forth perspective.
Figure 9:
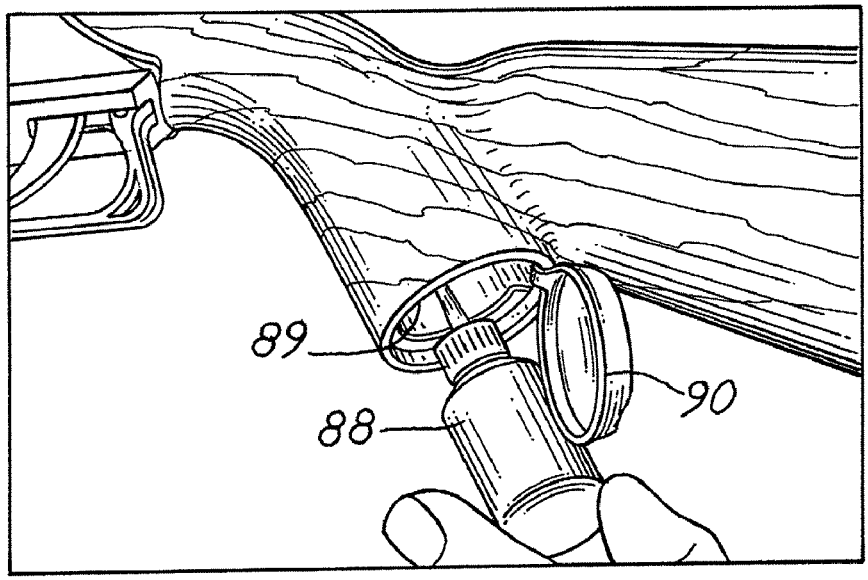
FIG. 9 shows a partial side view of the toy gun from a fifth perspective.
Figure 13:
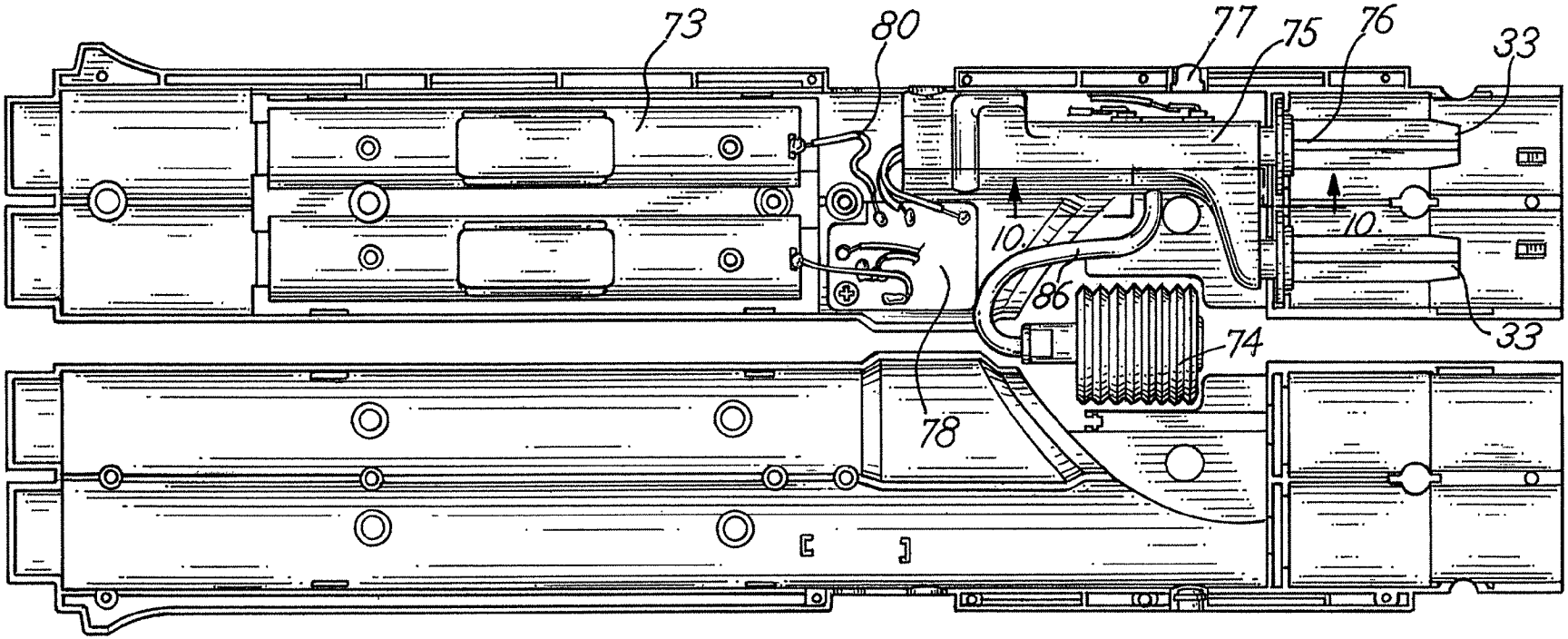
FIG. 13 shows a side view of individual components housed within the barrel of the toy gun.

The toy gun is also provided with a smoke generating assembly. As shown in FIG. 4, as the hinge 12 is opened, smoke 87 rises from the first and second chambers 31 and 32. As depicted in FIGS. 7 and 8, the barrel 16A is provided with an oil inlet 70 and a removable cap 71. Smoke oil stored in an oil container 88 is placed into an oil port 70. As depicted in FIG. 9, after oil is placed in the oil port 70, the oil container 88 can be stored in a recess 89. The recess 89 has a removable cover 90, which snap fits into the recess 89, to prevent the oil container 88 from falling out of the recess 89. To activate the smoke generator, a switch 72, located on the handle 15, shown in FIG. 6, is pressed inwardly. As depicted in FIG. 13, the double barrel 13 includes wiring 80, a power source 73, an automatic shutoff switch 78, a light emitting diode ("LED") 77, and a tank 75. When the switch 72 is activated, the LED 77 is turned on, and oil in the tank 75 is heated by a heating element 79, shown in FIG. 10. The LED 77 provides a visual indication that the heating element 79 is activated. The temperature of the oil rises as a result of the heating element 79 heating the oil, and the oil is converted into a visible gas or vapor 87. The smoke generating assembly includes a timer. The timer automatically shuts off the heating element 79 after a predetermined amount of time of nonuse, five minutes in one embodiment. After five minutes of nonuse, the automatic shutoff switch 78 cuts power to the LED 77, causing the LED to no longer be lit, and the heating element 79, causing it to no longer heat the oil. In one embodiment the smoke generating feature can be reset by pressing the switch 72 twice.

When the smoke generating assembly is activated, a pump 74 pushes smoke 87 out of openings 76 in the first and second posts 33A and 33B into the first and second chambers 30 and 31 as the hinge 12 is opened. As depicted in FIG. 14, the hinge 12 actuates the pump 74 causing the smoke 87 to flow from a tank 75 into the first and second chambers 30 and 31. A gear 83 mounts on one of the hinge posts 122, such that gear 83 rotates with the hinge 12. A pinion gear 82 meshes with the gear 83 and a rack 81. The pinion gear 82 allows the rack to move in a same translational direction of a rotational direction of hinge 12 such that the rack end 85 compresses the pump 74 when the hinge 12 is opened. A hose 86 connects the pump 74 to the tank 75. As the rack end 85 compresses the pump 74, compressed air created by the pump 74 pushes the smoke 87 produced by the heating element 79 out of the tank and into the first and second chambers 31 and 32 via the openings 76 in the posts 36.

The smoke oil ingredients can be water, glycerin, and sodium bezenefulfonate. Any ingredients, however, can be used such that a visible vapor is produced when the oil is heated.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It is also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art. Various features are set forth in the following claims.

We claim:

1. A toy gun apparatus comprising:

a shell, the shell comprising a spring;

a barrel having an elongated member with a first end and a second end, the first end having at least one chamber, the chamber comprising a post and a shell locking mechanism;

a stock having a butt end;

a hinge located between the stock and the barrel;

a receiver, the receiver having a projection, and wherein the projection releases the shell locking mechanism as the hinge is closed;

wherein when the shell is placed in the chamber, the spring is compressed by the post and the shell locking mechanism retains the shell in the chamber; and wherein upon opening the hinge, the spring decompresses ejecting the shell from the chamber.

2. The toy gun assembly of claim 1 wherein the barrel has a second chamber for a second shell.

3. The toy gun assembly of claim 1 further comprising:

a first clip and a second clip, the first clip and the second clip retaining the stock and barrel together when the toy gun assembly is in a shooting position;

an activation mechanism having a first push button and a second push button wherein the first clip and the second clip are released by simultaneous pressing of the first push button and the second push button, causing the hinge to open;

and wherein the hinge opens only by the simultaneous pressing of the first push button and the second push button.

4. The toy gun of claim 1 further comprising a trigger and wherein upon pulling the trigger, the toy gun produces a shooting noise.

5. The toy gun assembly of claim 4 further comprising an oil container; and wherein the stock further comprises a recess having a removable cover, the recess housing the oil container.

6. A toy gun assembly comprising:

a barrel having an elongated member with a first end and a second end, the first end having at least one chamber, the chamber comprising a post having an opening for smoke;

a stock having a butt end;

a hinge located between the stock and the barrel;

a smoke generating assembly comprising a pump, a tank having oil, and a heating element having a switch;

wherein when the switch is actuated the heating element heats the oil such that it transforms into a vapor; and wherein upon opening the hinge, the hinge actuates the pump causing vapor to leave the tank through the opening in the post into the chamber.

7. The toy gun assembly of claim 6 wherein the oil further comprises water, glycerin, and sodium benzenesulfonate.

8. The toy gun assembly of claim 6 wherein the smoke generating assembly further comprises a rack gear and a pinion gear, the hinge further comprising a gear, wherein the gear meshes with the pinion gear; and wherein when the hinge is opened, the hinge rotates the gear, thereby causing the pinion gear to cause the rack gear to translate and actuate the pump.

9. The toy gun assembly of claim 8 wherein the smoke generating assembly further comprises an oil port and a removable cap.

10. The toy gun assembly of claim 9 wherein during use, oil is placed in the oil port to refill the chamber.

11. The toy gun assembly of claim 10 further comprising an oil container and a recess having a removable cover, the recess housing the oil container.

12. The toy gun assembly of claim 11 further comprising a first clip and a second clip, the first clip and the second clip retaining the stock and barrel together when the toy gun assembly is in a shooting position, an activation mechanism having a first push button and a second push button wherein the first clip and the second clip are released by simultaneous pressing of the first push button and the second push button causing the hinge to open; and wherein the hinge opens only by the simultaneous pressing of the first push button and the second push button.

13. The toy gun assembly of claim 12 wherein the smoke generating assembly further comprises a visual indicator that indicates that the smoke generating assembly is activated.

14. The toy gun assembly of claim 13 wherein the visual indicator is a light emitting diode.

15. The toy gun assembly of claim 14 further comprising a trigger and wherein upon pulling the trigger, the toy gun produces a shooting noise.

16. The toy gun assembly of claim 13 wherein the smoke generator assembly further comprises an automatic shutoff, wherein after a predetermined amount of time, the automatic shutoff turns the heating element and the visual indicator to an off position.

17. The toy gun assembly of claim 6 further comprising a shell, wherein the shell is placed in the chamber, and wherein when the hinge is opened the shell ejects from the chamber.

18. The toy gun assembly of claim 17 wherein when the hinge is opened the vapor and the shell leave the chamber at substantially the same time.

19. A toy gun apparatus comprising:

a shell, the shell comprising a spring;

a barrel having an elongated member with a first end and a second end, the first end having at least one chamber, the chamber comprising a post having an opening for smoke, and a shell locking mechanism;

a stock having a butt end;

a hinge located between the stock and the barrel;

a smoke generating assembly comprising a pump, a tank having oil, and a heating element having a switch;

wherein when the shell is placed in the chamber, the spring is compressed by the post and the shell locking mechanism retains the shell in the chamber;

wherein when the switch is actuated the heating element heats the oil such that it transforms into a vapor; and wherein upon opening the hinge, the hinge actuates the pump causing vapor to leave the tank through the opening in the post into the chamber, and the spring decompresses ejecting the shell from the chamber.

* * * * *